US005660009A

United States Patent [19]

Cousin

[11] Patent Number: 5,660,009

[45] Date of Patent: Aug. 26, 1997

[54] METAL STAIRWAY FOR A RESIDENCE

[76] Inventor: Matthew E. Cousin, 2411 Exposition Pl., Los Angeles, Calif. 90018

[21] Appl. No.: 381,346

[22] Filed: Jan. 31, 1995

[51] Int. Cl.[6] ..... E04F 11/025; E04F 11/09

[52] U.S. Cl. ..... 58/183; 52/182; 52/188; 52/191

[58] Field of Search ..... 52/182, 183, 184, 52/185, 188, 191; 182/228

[56] References Cited

U.S. PATENT DOCUMENTS

| | | | |
|---|---|---|---|
| 724,790 | 4/1903 | Bois . | |
| 751,098 | 2/1904 | Ohnstrand . | |
| 847,699 | 3/1907 | Scherbner . | |
| 919,789 | 4/1909 | Steiber . | |
| 973,109 | 10/1910 | Griner | 52/188 |
| 1,063,216 | 6/1913 | Rendle et al. | 52/188 |
| 1,069,596 | 8/1913 | Baldry | 52/188 |
| 1,219,614 | 3/1917 | Woodbridge . | |
| 1,343,739 | 6/1920 | Nesdall . | |
| 1,385,209 | 7/1921 | Hall . | |
| 1,436,281 | 11/1922 | Mitchell | 52/188 |
| 1,474,850 | 11/1923 | Rudloff | 52/191 |
| 1,587,281 | 6/1926 | Burnham | 52/191 |
| 1,789,969 | 1/1931 | Davis | 52/184 |
| 1,862,958 | 6/1932 | Hall | 52/191 |
| 2,015,945 | 3/1935 | MacDonald . | |
| 2,105,565 | 1/1938 | Von Schantz | 52/191 |
| 2,193,146 | 3/1940 | Skeel et al. . | |
| 2,205,859 | 6/1940 | O'Donnell . | |
| 2,377,994 | 6/1945 | Cocken, Jr. | 52/182 |
| 3,099,336 | 7/1963 | Hawkins | 52/182 |
| 4,004,384 | 1/1977 | Hood . | |

FOREIGN PATENT DOCUMENTS

| | | | |
|---|---|---|---|
| 1150513 | 8/1957 | France | 52/182 |

*Primary Examiner*—Carl D. Friedman
*Assistant Examiner*—Kevin D. Wilkens
*Attorney, Agent, or Firm*—Henry M. Bissell

[57] ABSTRACT

A metal stairway constructed on site in a metal framed house. The stair steps are supported between a pair of trimmed sheet metal stringer panels on each side of the stairway. Each step of the stairway is formed of metal treads and risers cut to appropriate lengths from conventional joist members provided on site for the metal framed house. The metal treads and risers are attached at opposite ends thereof to the respective stringer panels by way of standard angled brackets provided on site for securing metal framing members together. Threaded self-drilling fasteners attach each angled bracket to a corresponding stringer panel and to an associated metal tread or metal riser. Wooden treads and risers are attached over the metal treads and risers by standard self-drilling screws.

12 Claims, 2 Drawing Sheets

10
12
14
16
18
20
22
34
2

42
40
44
38
46
16
28
32
48
30
24
26
50
36
39
37

METAL STAIRWAY FOR A RESIDENCE

BACKGROUND OF THE INVENTION

1. Field of the Invention

This invention relates to improvements in techniques for residential construction and, more particularly, to the fabrication on site of metal stairways for residences which are constructed of readily available standard building components.

2. Description of Related Art

The fabrication of stairways for residential construction has for a long time customarily involved the cutting of pieces to form the respective treads and risers and securing these in position on brackets which are nailed to wooden side panels that provide the principal support for the stairway. The treads and risers in this type of construction are also generally secured to each other to render the structure more stable and secure, and to avoid the squeaking sounds which are not infrequently encountered in wooden stairways.

Metal stairways have also been known and used for a considerable period of time, and those which have been found in prior art patents are considered to fall into one of three different categories, depending upon the types of structures which are disclosed.

U.S. Pat. Nos. 724,790 of N. Bois and 751,098 of E. Ohnstrand disclose unitary stairways which are prefabricated. The principal objective is stated in one patent to be for use in fireproof buildings, banks and the like. Such construction requires expensive manufacturing machinery and the added cost does not make the stairways attractive for use in residential construction. Their design precludes on-site fabrication.

O'Donnell in U.S. Pat. No. 2,205,859 and Hood in U.S. Pat. No. 4,004,384 disclose integral tread-and-riser combinations as well as specially constructed stringers which are prefabricated. This construction also precludes basic and complete fabrication on site.

The Scherbner U.S. Pat. No. 847,699 discloses a metal staircase having wooden treads. The staircase includes metal tread supports and risers which are integrally formed by pairs and fastened together and to the metal stringers or side pieces by bolts or rivets. Likewise, the U.S. Pat. Nos. 1,219,614 of Woodbridge, 1,343,739 of Nesdall, 1,385,209 of Hall and 2,193,146 of Skeel et al all disclose stairway structures comprising integrally formed sets of treads and risers which involve special shaping of the sheet metal employed to form the respective combinations. This type of construction calls for prefabrication with relatively complex and expensive machinery and precludes construction of basic elements at the site.

The MacDonald U.S. Pat. No. 2,015,945 and the Steiber U.S. Pat. No. 919,789 disclose metal stairways formed of side stringers with separate treads and risers. However, these separate elements are still constructed of specially fabricated members. For example, MacDonald discloses treads having a bull-nose front portion including a downwardly depending flange for attachment to the adjacent riser. Similarly, Steiber discloses treads including corrugated longitudinal ribs or gutters which are pressed into the material for stiffening and ornamentation.

Fabrication of these elements requires special machinery which adds to the expense of the components and the overall stairway.

SUMMARY OF THE INVENTION

In brief, particular arrangements in accordance with the present invention comprise a metal stairway designed to be constructed on site, primarily during the framing stage in the construction of a residence having metal framing. The respective metal components of the stairway are all standard items which are used in the construction of a metal-framed house. The components of the stairway, such as the stringer panels, the angled support brackets, the treads, risers and fasteners are all readily available at the site as standard items provided for the metal framing of the house and require no more than cutting or trimming to size for use in the fabrication of the stairway. The stringer panels and the treads and risers which are formed of framing channel joists are cut to the appropriate dimensions of the stairway. The side supports for the treads and risers are standard angle brackets of the type used elsewhere in the metal framing of the house.

In accordance with the invention, the stringers which constitute the two opposite side panels of the stairway are cut of 20 gauge sheet metal, one foot wide and cut at the ends in accordance with the angle of the stairway relative to the vertical. The length of the stringers corresponds to the length of the stairway. The stringers are secured to respective metal studs by No. 10, ¾-inch metal fasteners having No. 3 points (also standard construction items). These are driven into holes near the upper and lower edges of a stringer where the stringer overlaps the metal stud by portable power drivers. Placement of the stringers in this manner not only provides secure support for the side panels of the stairway, but it also provides reinforcement and stabilization of the metal studs to which the stringers are fastened.

The supports for the metal treads and risers are precut standard angle brackets commonly used for joist supports in the metal framed house. The side support brackets are in lengths of approximately 6 inches for the riser supports and about 9 inches for the tread supports. The supports are secured to the stringer panels on both sides in the same manner as the stringers are fastened to the metal studs; namely, by No. 10, ¾-inch long threaded metal fasteners with No. 3 points which are driven through holes drilled in the metal members by portable power drivers. The supports for a single step comprise 16 gauge Simpson L-50 angle brackets for the riser and 16 gauge Simpson L-90 angle brackets for the tread.

The treads are cut from 14 P channel joist material 10 inches wide. The risers are cut from 14 P channel joist material 8 inches wide. These are cut to lengths equalling the width of the stairway and correspond in number to the number of steps in the stairway. The channel joist members from which the treads and risers are cut have a cross-sectional configuration which is generally U-shaped but with square corners. At the end of each side of the squared U is a small re-entrant section which is also U-shaped. These respective tread and riser elements are secured in position to the side brackets by three metal fasteners of the type already used at each end of their respective tread riser element. For each tread, one side of the U-shaped cross section provides a downwardly depending flange at the rearward side which bears against the adjacent riser. No. 10, ¾-inch threaded metal fasteners having No. 3 points are used to secure the riser to the rearward flange of the adjacent tread at approximate 6 inch spacing.

In similar fashion, the upper side of the U-shaped riser provides a flange which bears against the bottom of the re-entrant U-shaped portion of the tread member which is just above it. No. 10, ¾-inch threaded fasteners with No. 3 point are driven from the underside of the upper riser flange into the adjacent tread re-entrant portion at approximate 6 inch spacing to secure the forward edge of the tread securely to the riser immediately below it.

This manner of construction provides an element of adjustability wherein different heights of the risers can be accommodated without requiring any change in the components that are used in fabrication of the stairway. For stairways utilizing 8 inch risers, the downwardly depending flange at the rear of the tread overlaps the adjacent riser with about 1 inch of the riser extending below the lower termination of the flange. Thus, if a riser of 8½ inches or 9 inches is desired, the support brackets which are attached to the stringer side panels are positioned accordingly and the relative positions of the treads and risers are adjusted. Joining of the treads and risers with the No. 10 metal fasteners is accomplished in the same manner as already described. The fasteners are driven through to join the two overlapping portions of the adjacent tread and riser, the degree of overlap being determined by the height of the riser.

After the treads and risers are fastened to their respective side support brackets and the adjacent treads and risers are fastened to each other as described, the stairway is finished by applying cut sections of 1⅛ inch structural plywood cut to the appropriate dimensions of the treads and risers. The forward edge of each tread is shaped, as with a router, to provide a gentle curve between the horizontal surface and the front edge. Construction adhesive is applied between the plywood treads and risers and the respective channel joist segments making up the corresponding tread and riser supports, and threaded fasteners in the form of No. 8,1¾ inch drill point screws. Three such fasteners are provided with equal spacing at each end of the treads, while two such fasteners are provided at each end of the risers. The curved front edge of the tread is rounded to a ¼ inch radius.

BRIEF DESCRIPTION OF THE DRAWINGS

A better understanding of the present invention may be realized from a consideration of the following detailed description, taken in conjunction with the accompanying drawing in which.

DESCRIPTION OF THE PREFERRED EMBODIMENT

Figures 1, 2, 4:
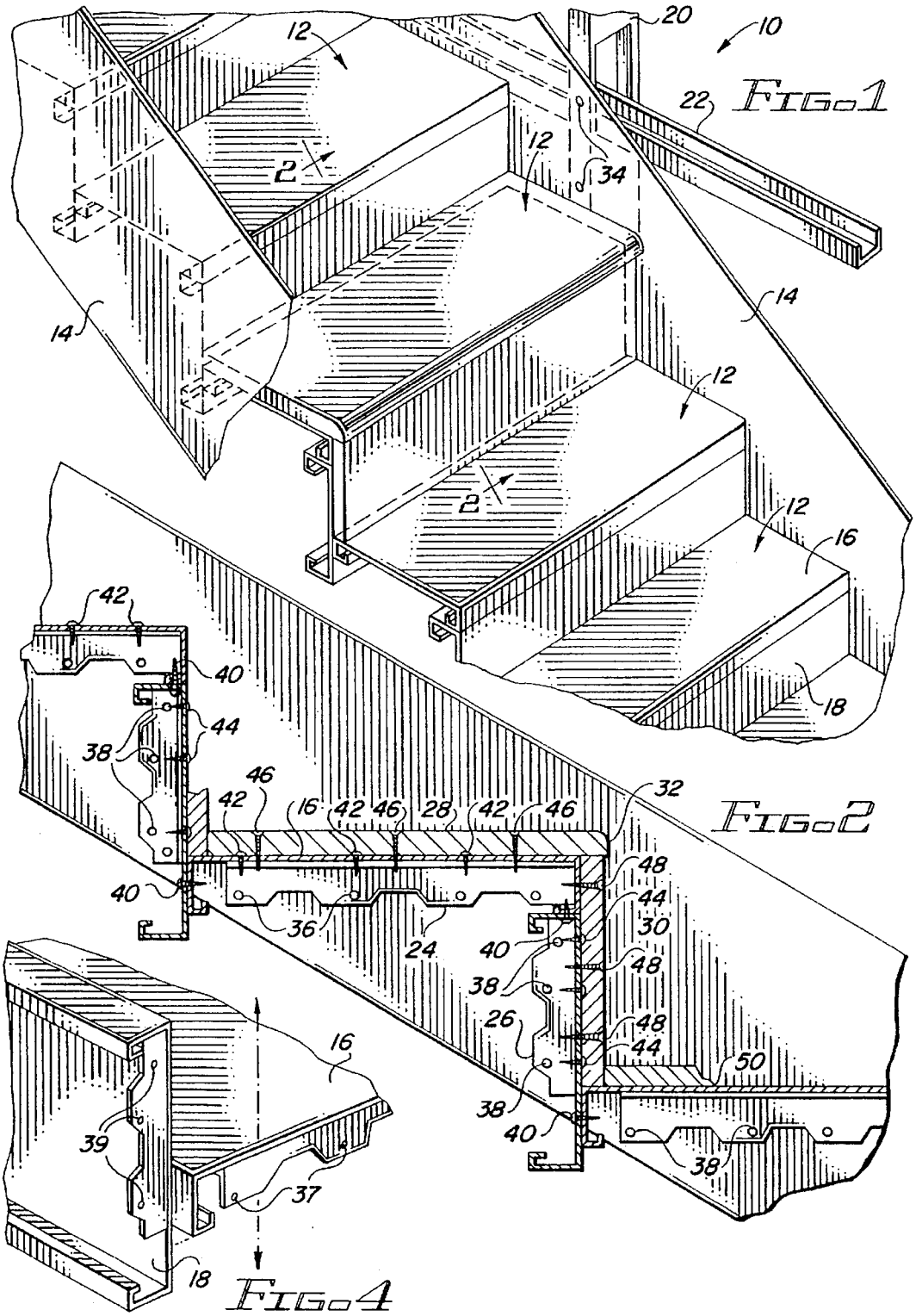
FIG. 1 is a perspective view, partially broken away, of one particular arrangement in accordance with the present invention.
FIG. 2 is a sectional view of that portion of the arrangement in FIG. 1 which is indicated by the numbers 2—2.
FIG. 4 is a perspective view showing some of the elements represented in FIG. 2.
Figure 5:
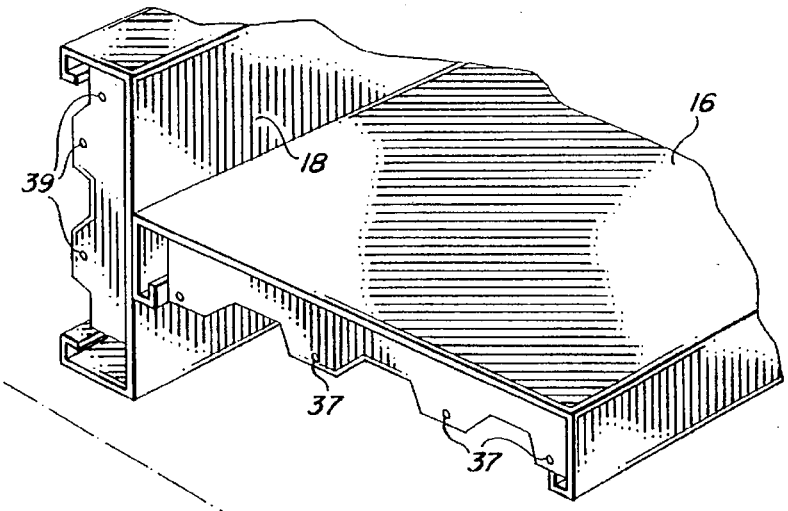
FIG. 5 is a perspective view of the two elements depicted in FIG. 4, taken from a different angle.

The stairway 10 of the present invention is best shown in FIG. 1 with particular details thereof being depicted in the remaining figures. As seen in FIG. 1, stairway 10 comprises a plurality of steps such as 12 extending between left and right stringer panels 14. These are secured to adjacent vertical studs 20 by fasteners 34 which extend into studs 20. The fasteners 34 are preferably No. 10, ¾-inch threaded metal fasteners with No. 3 self-drilling points. A U-shaped channel 22 is shown extending through an aperture in the stud 20.

Each of the steps 12 comprises a metal channel tread 16, a metal channel riser 18, a wooden tread 28 and a wooden riser 30. The metal channel treads 16 are supported on tread support brackets 24 which are fastened to the stringer panels 14 by fasteners 36 extending through openings 37. The metal channel risers 18 are secured to riser support brackets 26 which are attached to the adjacent stringer panels 14 by means of fasteners 38 extending through openings 39. All of the fasteners 34, 36 and 38 are preferably the same type: No. 10, ¾-inch threaded metal fasteners with No. 3 self-drilling points. Each of the metal treads 16 is cut to the width of the stairway from standard 10-inch wide channel members which are readily available at the construction site, customarily used as floor and ceiling joists. As such, each metal tread 16 is generally U-shaped with squared corners 17A. Each side leg of the U-shape 16 has re-entrant portions 17B at the open end of the U. Each metal riser 18 is similarly formed of standard 8-inch wide sheet metal channels, also customarily available at the construction site, as floor or ceiling joist members. The metal channel riser 18 is generally U-shaped with squared corners 19A and each side leg is also provided with a re-entrant portion 19B at the open end of the U.

The metal treads 16 and risers 18 are fastened together by threaded fasteners 40 equally spaced on six inch centers from side to side of the stair step. Each metal tread 16 is secured to its corresponding support bracket 24 by three equally spaced fasteners 42 at each end of the metal tread 16. Similarly, each metal riser 18 is secured to its corresponding support brackets 26 by three equally spaced fasteners 44 at each end of the tread 16. The fasteners 40, 42 and 44 are preferably the same as the fasteners 34, 36 and 38; namely, No. 10, ¾-inch threaded metal fasteners with No. 3 self-drilling points.

The wooden treads are secured at each end by three treaded fasteners 46. Similarly, the wooden risers are secured at each end by three fasteners 48. The fasteners 46 and 48 are preferably No. 8, 1¾-inch threaded metal fasteners with self-drilling points which penetrate into the metal treads and risers 16, 18 and the corresponding support brackets 24, 26. Before the wooden treads and risers are mounted, construction adhesive 50 is applied to the metal channel to help secure the wooden treads and risers in place. The wooden treads may be provided with a bullnose top corner shape 32 for enhanced esthetics and safety.

Figure 3:
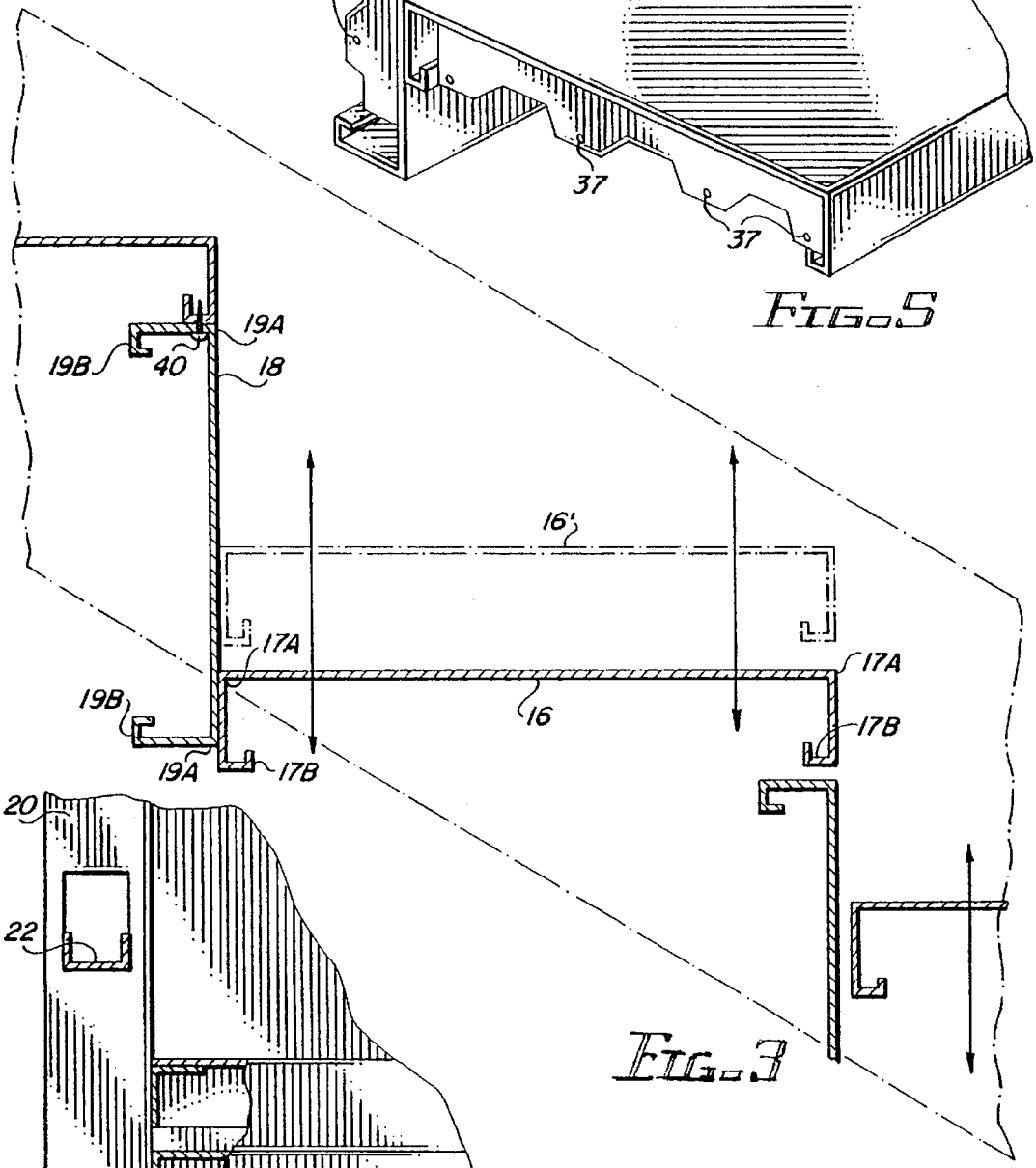
FIG. 3 is a schematic view of a portion of FIG. 1 illustrating a feature of adjustability of the invention.
Figure 6:
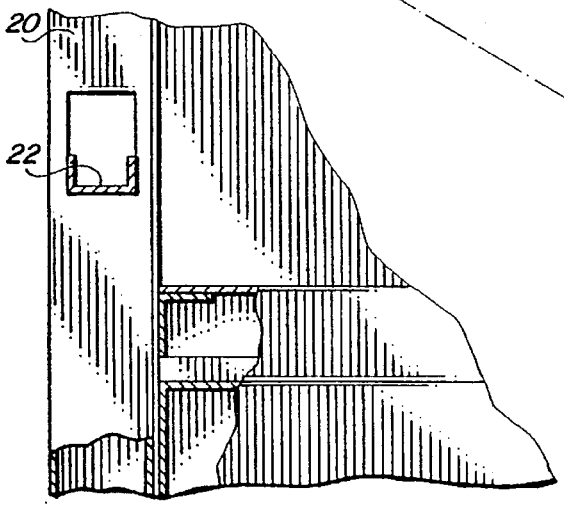
FIG. 6 is a schematic view, partially broken away and in partial section, of a portion of the stairway of FIG. 1.

As best indicated in FIGS. 3 and 4, the adjustability of the vertical spacing of the stair steps as a feature of the present invention is shown. Each individual metal tread 16 may be vertically adjusted within a range of overlap relative to the adjacent metal riser 18 which is next above it, as indicated by the comparison of the position of the metal tread 16 in FIG. 3 with the position of the metal tread 16' shown in phantom outline. Once the desired position is attained, metal fasteners 40 are driven through the vertical riser 18 into the adjacent side leg portion of the metal tread 16 to secure the components together. This is, of course, done in conjunction with the positioning of the support brackets 24, 26 which are also used in setting the positions of the metal treads and risers 16, 18 to develop the desired height of the stair steps.

The preferred embodiment of the present invention provides a number of benefits in the construction of a metal stairway for a metal framed house. All of the components used in the construction of the stairway derive from site-available materials. The support brackets and the fasteners are standard items which are commonly used in the construction of the house. The metal treads and risers are cut from standard floor and ceiling joists; all that is required is a metal saw to cut the joist channels to the desired lengths to form the treads and risers. The two stringer panels are formed of flat sheet metal, again simply by using a metal saw to cut the sheet metal to the desired size. No off-site prefabrication, metal forming, pre-assembly or the like is required with attendant special transportation arrangements and added costs. There is minimal wasted material in the fabrication of stairways corresponding to the present invention. Construction of the stairway as described results in a solid, secure, long lasting, termite proof structure at substantially reduced cost.

Although there have been shown and described hereinabove specific arrangements of a metal stairway for a residence in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. A stairway for a house, said house being constructed of metal frame members, said members comprising conventional U-shaped metal floor and ceiling joists and metal studs, said stairway being constructed on site of site-available components including cut portions of said joists, the stairway comprising:

a pair of sheet metal stringer panels, one on each side of the stairway, each panel being cut of sheet metal to a configuration corresponding to the height and angle of ascent of the stairway;

a first plurality of fastening members adapted to attach the stringer panels, respectively, to adjacent metal frame members of the house;

a plurality of steps in said stairway, each step including:

a metal tread having an inner edge and outer edge, and a metal riser having an upper portion and a lower portion, wherein each of the metal treads and metal risers is a section of said U-shaped metal joists cut to a length equal to the width of the stair steps;

a second plurality of fastening members securing the metal riser at said upper portion to the metal tread along a junction between said metal riser and metal tread; and a wooden tread and a wooden riser mounted to cover the metal tread and metal riser, respectively, the wooden tread being shaped along its outer edge to form a bullnose top corner shape;

a plurality of first angled support members mounted in a generally horizontal orientation at the sides of the steps to the stringer panels for supporting the treads, each first angled support member having a mounting portion and a support portion oriented at a generally right angle to each other;

a plurality of second angled support members mounted in a generally vertical orientation at the sides of the steps to the stringer panels for supporting the risers, each second angled support member having a mounting portion and a support portion oriented at a generally right angle to each other;

a third plurality of fastening members securing the mounting portions of the first angled support members to the adjacent stringer panels, respectively;

a fourth plurality of fastening members securing the metal treads to the support portions of the first angled support members;

a fifth plurality of fastening members securing the mounting portions of the second angled support members to adjacent stringer panels, respectively;

a sixth plurality of fastening members securing the metal risers to the support portions of the second angled support members;

a seventh plurality of fastening members securing the wooden treads to and through corresponding associated metal treads to respective support portions of the first angled support members;

an eighth plurality of fastening members securing the wooden risers to and through corresponding respective support portions of the second angled support members; and means for mounting the inner edge of a metal tread to the lower portion of a metal riser of the next higher step at a distance from the top of the riser which is selectively variable within a predetermined range in order to vary the step height of the stairway.

2. The stairway of claim 1 wherein a base of each U-shaped metal joist forming said metal treads and risers is generally planar and wherein each side leg of the joist is joined to the base at a generally right angle.

3. The stairway of claim 2 wherein each side leg of the U is shaped to provide a re-entrant portion at the open end of the U, said re-entrant portion including a section extending orthogonally from the adjacent side leg and a lip portion extending toward the base of the U at right angles to said section extending orthogonally from the adjacent side leg.

4. The stairway of claim 3 wherein, in each separate step, the junction between the metal riser upper portion and the metal tread thereof includes said section of said re-entrant portion.

5. The stairway of claim 4 wherein said second fastening members securing the metal riser to the metal tread are threaded through a side leg of the riser into said re-entrant portion of the metal tread.

6. The stairway of claim 1 wherein each fastening member of said first, second, third, fourth, fifth and sixth pluralities is a No. 10, ¾ inch threaded metal fastener with a self-drilling point.

7. The stairway of claim 1 wherein each fastening member of said seventh and eighth pluralities is a No. 8, 1¾ inch threaded metal fastener with a self-drilling point.

8. The stairway of claim 1 further including a layer of adhesive between each wooden tread and each wooden riser and its associated metal tread or riser, respectively, to provide additional securement of the wooden treads and wooden risers to the associated metal treads and metal risers.

9. The stairway of claim 1 wherein each of said first and second angled support members is a standard angle bracket provided on site for mounting metal framing members together.

10. The stairway of claim 1 wherein said means for mounting comprise a ninth plurality of fastening members threaded through one side leg of a metal tread and into a planar base of the adjacent riser of the next higher step at the selected location of the tread relative to the top of the riser.

11. The stairway of claim 10 wherein each fastening member of said ninth plurality is a No. 10, ¾-inch threaded metal fastener with a self-drilling point.

12. A stairway for a house, said house being constructed of metal frame members, said members comprising conventional U-shaped metal floor and ceiling joists and metal studs, said stairway being constructed on site of site-available components including cut portions of said joists, the stairway comprising:

a pair of sheet metal stringer panels, one on each side of the stairway, each panel being cut of sheet metal to a configuration corresponding to the height and angle of ascent of the stairway;

a first plurality of fastening members adapted to attach the stringer panels, respectively, to adjacent metal frame members of the house;

a plurality of steps in said stairway, each step including:

a metal tread having an inner edge and outer edge, and a metal riser having an upper portion and a lower portion, said metal tread and metal riser each comprised of a section of said U-shaped metal joists cut on site to a length equal to the width of the stair steps;

a second plurality of fastening members securing the metal riser at said upper portion to the metal tread along a junction between said metal riser and metal tread; and a plurality of first angled support members mounted in a generally horizontal orientation at the sides of the steps to the stringer panels for supporting the treads, each first angled support member having a mounting portion and a support portion oriented at a generally right angle to each other;

a plurality of second angled support members mounted in a generally vertical orientation at the sides of the steps to the stringer panels for supporting the risers, each second angled support member having a mounting portion and a support portion oriented at a generally right angle to each other;

a third plurality of fastening members securing the mounting portions of the first angled support members to the adjacent stringer panels, respectively;

a fourth plurality of fastening members securing the metal treads to the support portions of the first angled support members;

a fifth plurality of fastening members securing the mounting portions of the second angled support members to adjacent stringer panels, respectively;

a sixth plurality of fastening members securing the metal risers to the support portions of the second angled support members;

means for mounting the inner edge of a metal tread to the lower portion of a metal riser of the next higher step at a distance from the top of the riser which is selectively variable within a predetermined range in order to vary the step height of the stairway.

* * * * *